United States Patent [19]

Pounder

[11] Patent Number: 4,993,240

[45] Date of Patent: Feb. 19, 1991

[54] FACIAL ADORNMENT

[76] Inventor: C. J. Pounder, 225 Northtown, Spokane, Wash. 99207

[21] Appl. No.: 414,196

[22] Filed: Sep. 28, 1989

[51] Int. Cl.[5] ..... A44C 7/00

[52] U.S. Cl. ..... 63/12; 63/14.2; 63/14.7

[58] Field of Search ..... 63/12, 13, 14.1, 14.2, 63/14.4, 14.7, 14.8

[56] References Cited

U.S. PATENT DOCUMENTS

| | | | |
|---|---|---|---|
| 468,883 | 2/1892 | Marsters . | |
| 1,602,239 | 10/1926 | Miller | 63/14.2 |
| 2,409,369 | 10/1946 | Lo Carto | 63/14.2 |
| 2,525,195 | 8/1947 | Austrin et al. . | |
| 2,718,128 | 9/1952 | Richards . | |
| 2,878,660 | 9/1958 | Schweikert . | |
| 2,914,928 | 12/1959 | Warden | 63/14.2 |
| 4,282,721 | 8/1981 | Roach et al. . | |

FOREIGN PATENT DOCUMENTS

| | | | |
|---|---|---|---|
| 614888 | 4/1926 | France . | |
| 616209 | 4/1926 | France . | |
| 755650 | 11/1933 | France . | |
| 44313 | 12/1933 | France . | |
| 887873 | 11/1943 | France . | |
| 936058 | 7/1948 | France . | |
| 2242946 | 4/1975 | France . | |
| 2519523 | 7/1983 | France | 63/12 |
| 264060 | 12/1949 | Switzerland . | |
| 0007563 | of 1911 | United Kingdom . | |
| 186003 | 9/1922 | United Kingdom . | |
| 582658 | 11/1946 | United Kingdom . | |
| 629539 | 9/1949 | United Kingdom | 63/14.2 |

*Primary Examiner*—James R. Brittain

*Attorney, Agent, or Firm*—Wells, St. John & Roberts

[57] ABSTRACT

A facial adornment comprising a C-shaped support to be worn in conjunction with a conventional earring. The support is placed over the ear of a wearer. A decorative member extends generally downward from the upper front end of the support at the top front of the wearer's ear. The lower end of the support is stabilized and held in place by attachment to the earlobe with a conventional earring. A connection for vertically adjusting the position of the earring on the support allows convenient fitting for various sizes of ears.

8 Claims, 3 Drawing Sheets

FACIAL ADORNMENT

TECHNICAL FIELD

This invention is a new and useful facial adornment which is worn over the ear in conjunction with a conventional earring.

BACKGROUND OF THE INVENTION

Earrings are conventionally fastened directly to the ear either by clamping around the earlobe or by pinning through a pierced earlobe. The decorative portion of an earring is usually located at the front of the earlobe or is suspended by a small chain from the earlobe.

It is less common for decorative jewelry elements to be placed at or suspended from the upper front portion of the ear. One known manner of placing jewelry in this position is to use a supporting hook which fits over the top of the ear. Such a hook might fit along the side of the wearer's head, and extend from the upper front of the ear, around the top and back of the ear, and around the lower part of the ear. A second decorative item might be placed at or suspended from the lower part of the hook which would be located near the front of the earlobe. In this way, jewelry can be worn near the earlobe without the discomfort often caused by conventional earrings.

When a wearer desires ornamentation at both the front of the ear and the earlobe, the hook described above must fit very snugly to prevent its falling from the ear. Accordingly, these hooks must be individually fitted to each wearer's ear. Even after fitting, the hook might be uncomfortable. Being unconnected to the body of a wearer, such hooks are also susceptible to displacement and can fall from the ear quite easily.

The present disclosure combines a support for jewelry elements worn adjacent the face and in front of an ear with an adjustable bracket that is attachable to a conventional earring to securely maintain the support in position behind the ear of a wearer. It also provides mechanical support to carry all or part of the suspended weight of an earring as it is worn.

BRIEF DESCRIPTION OF THE DRAWINGS

The preferred embodiment of the invention is illustrated in the accompanying drawings, in which.

DETAILED DESCRIPTION OF THE PREFERRED EMBODIMENTS

Figure 1:
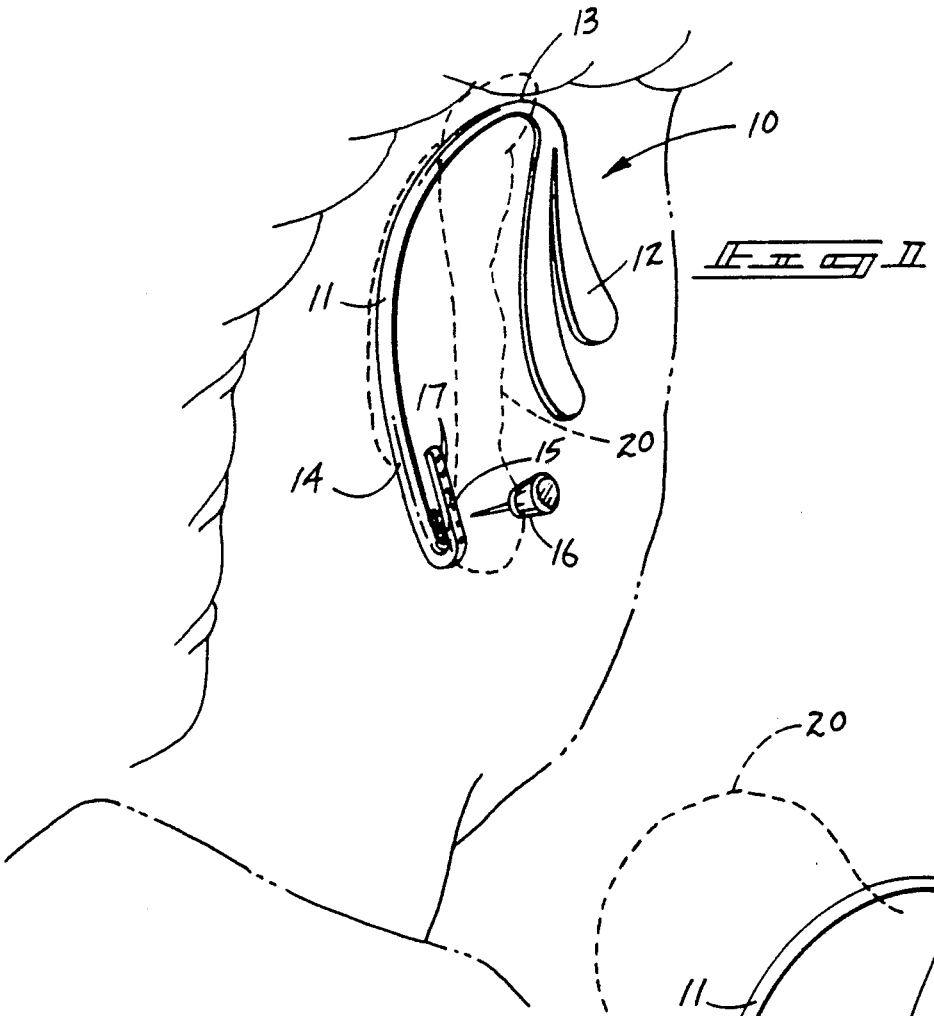
FIG. 1 is a perspective view showing a first embodiment of the invention on a wearer's ear.

The following disclosure of the invention is submitted in furtherance with the constitutional purpose of the Patent Laws "to promote the progress of science and useful arts" (Article 1, Section 8).

The facial adornment of this invention is generally comprised of a C-shaped support which is placed over the top of the ear. A decorative member extends generally downward from the upper front end of the support at the top front of the wearer's ear. The lower end of the support is stabilized and held in place by clamping it to the earlobe using a conventional earring. Thus, ornamentation is provided both at the earlobe and along the front of the ear. To compensate for differing sizes of ears, the lower end of the support is configured to receive the earring in adjustable positions relative to the support.

Because of this configuration, the support can be shaped to fit somewhat loosely around the top of the ear, while still being held securely in place by the attached earring. In addition, individual sizing of the support is not required. Wearers, depending on the size of their ears, can readily adjust the support as necessary. Accordingly, the facial adornment is more convenient and more comfortable to wear than previous devices which have attempted to support jewelry elements at similar facial locations.

FIGS. 1 through 4 show a first embodiment of this invention. The facial adornment is generally designated by reference numeral 10.

Figure 2:
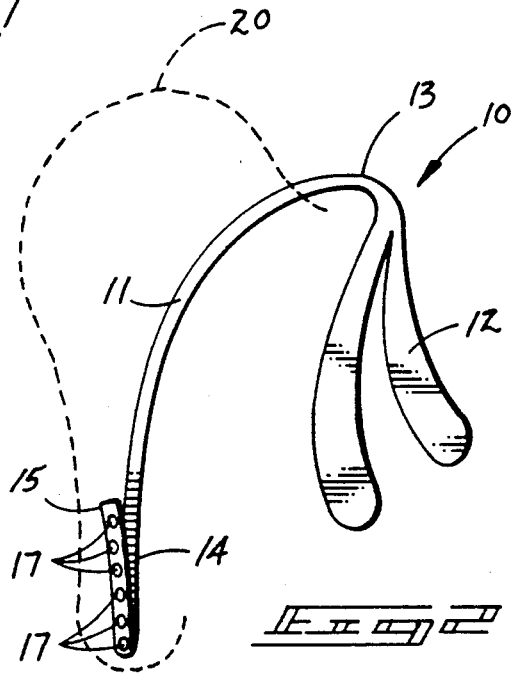
FIG. 2 is a side view.
Figure 3:
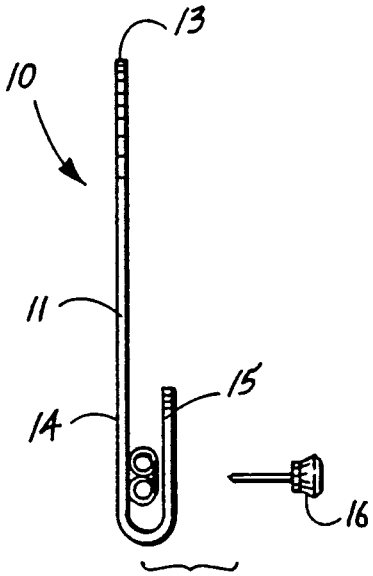
FIG. 3 is a rear view.
Figure 4:
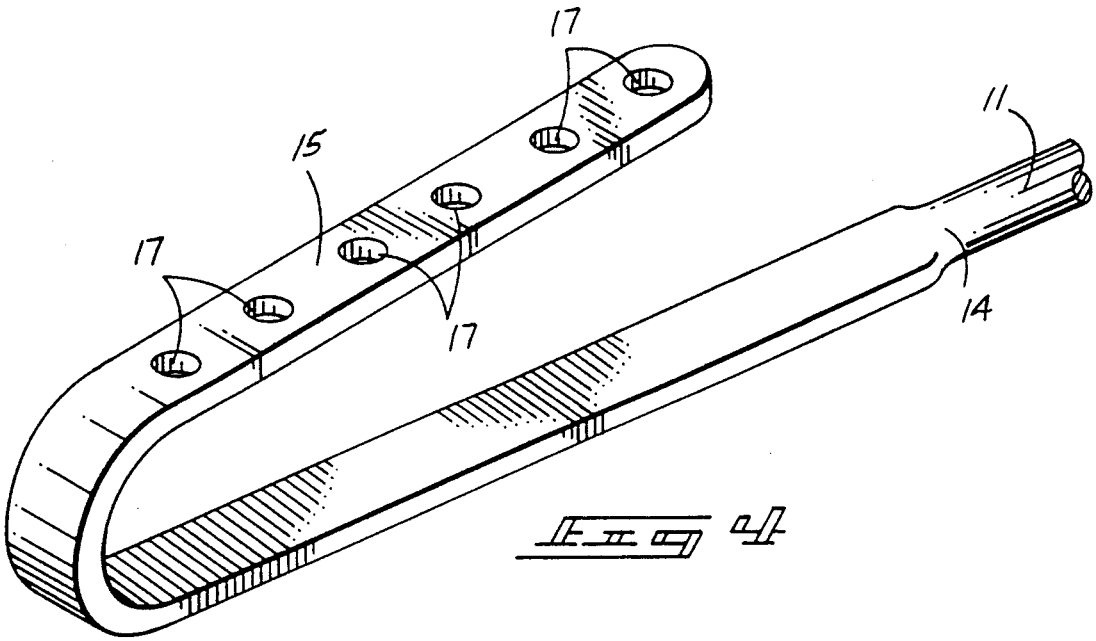
FIG. 4 is an enlarged detail of an adjustable bracket, part of the first embodiment of this invention.

A C-shaped support 11 is adapted to wrap around the top of the ear 20 as best shown in FIGS. 1 and 2. The support 11 is formed from a small rod of circular cross-section which has a first end 13 located at the top front of the ear and a second end 14 located immediately behind the earlobe.

A decorative member 12 extends generally downwardly along the face from the first end 13 of support 11.

An adjustable bracket 15 is provided at the second end of support 11. A conventional earring 16, having a post designed for pierced ears, can be placed through the ear and secured to the ear of a wearer through the apertured bracket. This stabilizes the support 11 and to holds it in place against the earlobe. Alternatively, a clamp-type earring could be used in a similar way to secure the second end 14 of the support 11 to the earlobe.

In the first illustrated embodiment, the bracket is made by flattening the lower portion of the rod forming the support 11. The flattened rod is then bent upwardly to form a U-shaped end section integral with support 11 in a plane generally perpendicular to the plane of the C-shaped support (see FIG. 3). Multiple apertures 17 are formed in the flattened rod to receive the post of an earring 16.

In use, the support 11 is placed over the ear. An earring 16 is placed through a pierced ear and then through one of the apertures 17 in the bracket 15. The particular aperture chosen will depend upon the size of the ear and the location at which the ear lobe was pierced.

Figure 5:
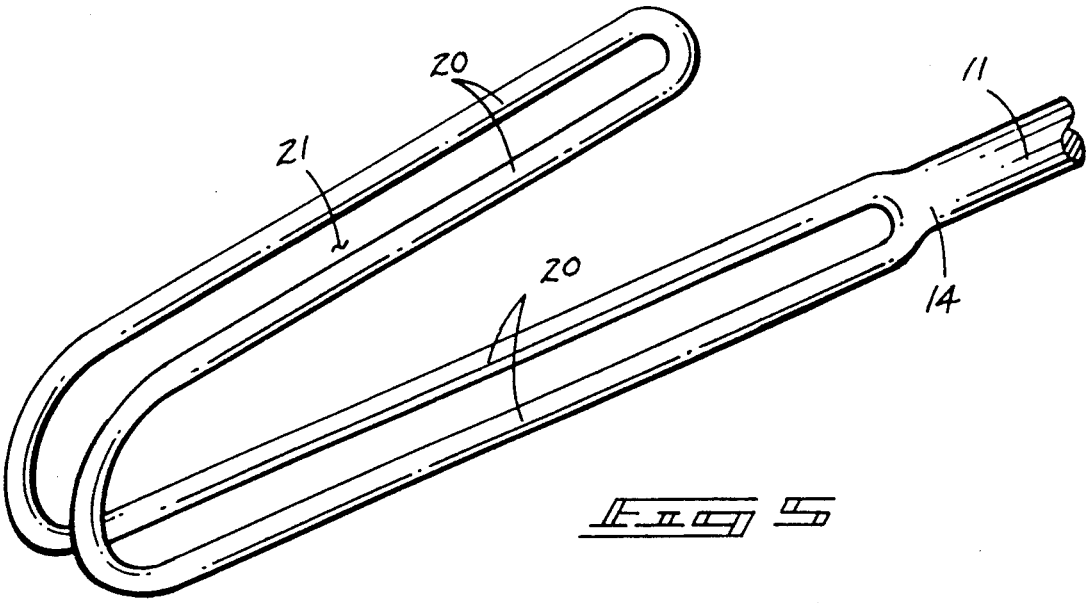
FIG. 5 is an enlarged detail of an alternate embodiment of the adjustable bracket.

Those skilled in the art will realize that the adjustable bracket can be made in different ways. For example, FIG. 5 shows a second embodiment of the adjustable bracket consisting of a pair of rod sections 20, spaced to form a slot 21 that extends from the second end 14 of the support 11. The rod sections 20 are bent upwardly to form a U-shaped bracket in a plane which is generally perpendicular to the plane of support 11. The post of an earring 16 can be received through the slot 21 as previously described. The slot 21 provides a means for adjusting placement of the earring similar to the multiple apertures 17 of the first embodiment.

Figure 7:
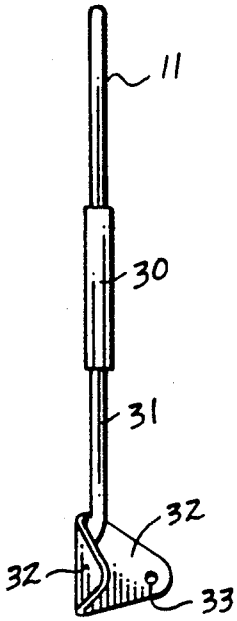
FIG. 7 is a rear view of the embodiment of the invention illustrated in FIG. 6.
Figure 6:
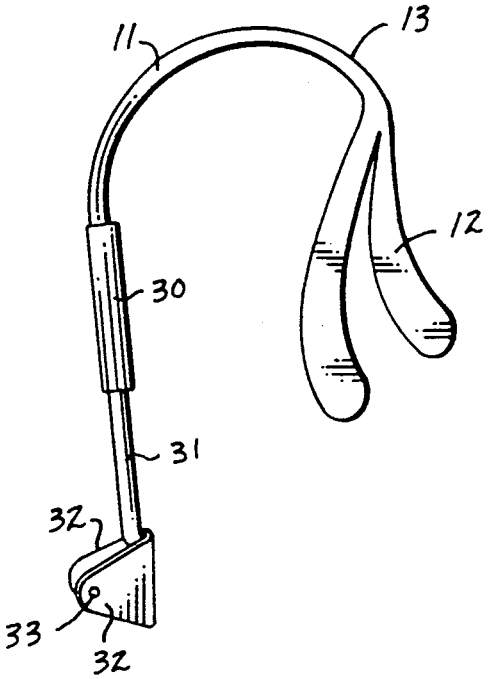
FIG. 6 is a side view of an additional embodiment of the invention.
Figure 8:
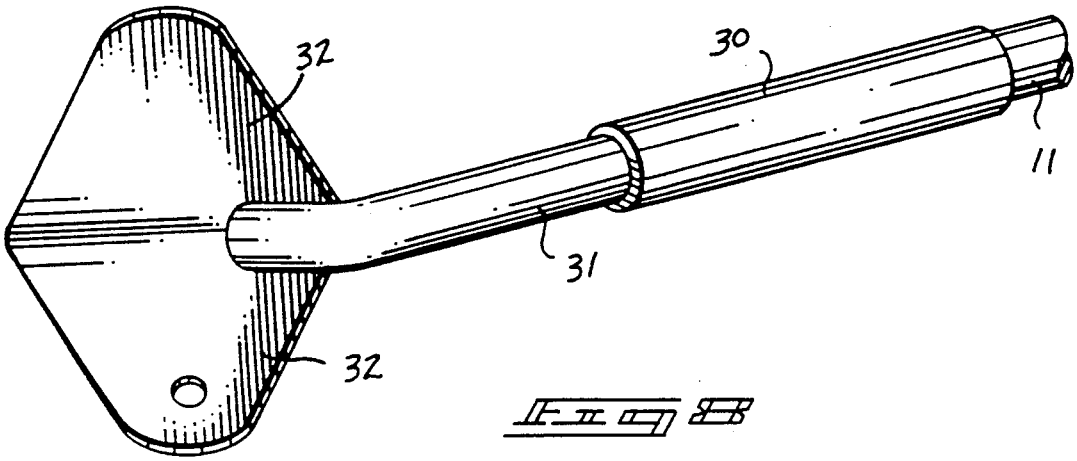
FIG. 8 is an enlarged detail of the adjustable bracket, part of the embodiment of this invention as illustrated in FIG. 6.

FIGS. 6–8 illustrate an additional embodiment of the invention. Elements previously described with respect to the embodiments shown in FIGS. 1–5 are indicated in FIGS. 6–8 by identical reference numerals.

The lower end of support 11 is provided with a telescoping extension comprised of a hollow tube 30 that frictionally receives a downwardly extending rod 31. The lower end of rod 31 is attached to the center of an integral pair of bendable leaves 32. At least one of the leaves 32 is apertured at 33 to receive the post of a conventional earring.

Rod 31, as well as the attached leaves 32, is vertically adjustable and can be swiveled within the supporting tube 30 for adjustment in the length and angular position of the earring bracket provided by the apertured leaf 32. The leaves 32 can be bent relative to the lower end of rod 31 to fit the anatomy of a specific wearer. The two leaves 32 should be adjusted to rest against the head of the wearer and against the ear lobe to which the attached earring is mounted.

In compliance with the statute, the invention has been described in language more or less specific as to structural features. It is to be understood, however, that the invention is not limited to the specific features shown, since the means and construction herein disclosed comprise a preferred form of putting the invention into effect. The invention is, therefore, claimed in any of its forms or modifications within the proper scope of the appended claims appropriately interpreted in accordance with the doctrine of equivalents.

I claim:

1. A facial adornment adapted to be worn on the ear in conjunction with a conventional earring, comprising:

a C-shaped support adapted to rest over the back of an ear in a position adjacent to the head of a wearer, the support having first and second ends adapted to be located at the top front corner of the ear and immediately behind the earlobe, respectively, the support being substantially planar;

a decorative member at the first end of the support, the decorative member being adapted to extend downwardly along the face of a wearer at a location forward of the ear;

an elongated extension integrally bent back from the second end of the support to form a U-shaped end section across a first plane substantially perpendicular to the plane of the support;

the extension lying within a second plane substantially parallel to and spaced from the plane of the support, the extension being adapted to be positioned against the back of an earlobe of a wearer;

an opening formed through the extension, the opening being adapted to adjustably receive the mounting pin of a conventional earring along the length of the extension;

the U-shaped end section being adapted to hold the support against the head of a wearer when the mounting pin of a conventional earring is clamped within the opening and through the earlobe of a wearer with the extension engaged behind and against the earlobe.

2. A facial adornment adapted to be worn on the ear in conjunction with a conventional earring, comprising:

a C-shaped support adapted to rest over the back of an ear in a position adjacent to the head of a wearer, the support having first and second ends adapted to be located at the top front corner of the ear and immediately behind the earlobe, respectively, wherein the support is substantially planar and comprises a continuously curved elongated rod having a cylindrical cross-sectional configuration;

a decorative member at the first end of the support, the decorative member being adapted to extend downwardly along the face of a wearer at a location forward of the ear;

adjustable bracket means at the second end of the support for connection to a conventional earring worn on the earlobe;

the adjustable bracket means comprising:

an integral extension bend back from the second end of the support within a plane substantially perpendicular to the plane of the support, the extension being flattened in a plane substantially parallel to the plane of the support; and multiple apertures formed in a row through the extension for reception of a mounting pin in a conventional earring.

3. A facial adornment adapted to be worn on the ear in conjunction with a conventional earring, comprising:

a C-shaped support adapted to rest over the back of an ear in a position adjacent to the head of a wearer, the support having first and second ends adapted to be located at the top front corner of the ear and immediately behind the earlobe, respectively, wherein the support is substantially planar and comprises a continuously curved elongated rod having a cylindrical cross-sectional configuration;

a decorative member at the first end of the support, the decorative member being adapted to extend downwardly along the face of a wearer at a location forward of the ear;

an integral extension bent back from the second end of the support to form a U-shaped end section within a plane substantially perpendicular to the plane of the support, the extension being flattened in a plane substantially parallel to the plane of the support and being spaced from the plane of the support, the extension being adapted to be positioned against the back of an earlobe of a wearer;

an elongated slot formed through the extension for reception of a mounting pin in a conventional earring.

the U-shaped end section being adapted to hold the support against the head of a wearer when the mounting pin of a conventional earring is clamped within the slot and through the earlobe of a wearer with the extension engaged behind and against the earlobe.

4. A facial adornment adapted to be worn on the ear in conjunction with a conventional earring, comprising:

a C-shaped support adapted to rest over the back of an ear in a position adjacent to the head of a wearer, the support having first and second ends adapted to be located at the top front corner of the ear and immediately behind the earlobe, respectively, wherein the support is substantially planar and comprises a continuously curved elongated rod having a cylindrical cross-sectional configuration;

a decorative member at the first end of the support, the decorative member being adapted to extend downwardly along the face of a wearer at a location forward of the ear;

adjustable bracket means at the second end of the support for connection to a conventional earring worn on the earlobe;

the adjustable bracket means comprising:

a telescoping extension at the second end of the support;

a swiveled earring bracket mounted to the telescoping extension; and the swiveled earring bracket having an integral pair of bendable leaves, at least one of the leaves being apertured to receive the post of a conventional earring.

5. A facial adornment adapted to be worn on the ear in conjunction with a conventional earring, comprising:

an elongated curved rod formed to fit around an ear, the rod extending from its lower end, adapted to be located behind the ear lobe, upwardly and around to an upper end adapted to be positioned adjacent to the face at the top front corner of the ear, wherein the support is substantially planar;

a decorative member fixed to the upper end of the rod, the decorative member being adapted to extend downwardly along the face at a location forward of the ear;

a pair of elongated rod sections integrally bend back from the lower end of the elongated rod to form a U-shaped end section within a plane substantially perpendicular to the plane of the support, the rod sections being spaced apart from one another to form an elongated slot between them for adjustably receiving the pin of an earring; and the U-shaped end section being adapted to hold the support against the head of a wearer when the mounting pin of a conventional earring is clamped within the elongated slot and through the earlobe of a wearer with the extension engaged behind and against the earlobe.

6. A facial adornment adapted to be worn on the ear in conjunction with a conventional earring, comprising:

an elongated curved rod formed to fit around an ear, the rod extending from its lower end, adapted to be located behind the ear lobe, upwardly and around to an upper end adapted to be positioned adjacent to the face at the top front corner of the ear;

a decorative member fixed to the upper end of the rod, the decorative member being adapted to extend downwardly along the face at a location forward of the ear; and vertically adjustable bracket means extending upwardly from the lower end of the rod for receiving the pin of an earring, wherein:

the elongated rod is bent upwardly at its lower end;

the upwardly bend portion of the elongated rod is flattened;

multiple apertures are formed in the flattened rod; and the upwardly bent flattened rod forms the adjustable bracket means.

7. A facial adornment adapted to be worn on the ear in conjunction with a conventional earring, comprising:

an elongated curved rod formed to fit around an ear, the rod extending from its lower end, adapted to be located behind the ear lobe, upwardly and around to an upper end adapted to be positioned adjacent to the face at the top front corner of the ear;

a decorative member fixed to the upper end of the rod, the decorative member being adapted to extend downwardly along the face at a location forward of the ear; and vertically adjustable bracket means extending upwardly from the lower end of the rod for receiving the pin of an earring;

wherein the vertically adjustable bracket means comprises a flattened section of the rod bend back in a U-shaped configuration extending upwardly from the lower end of the elongated rod, the flattened section of the rod having multiple apertures formed through it.

8. A facial adornment adapted to be worn on the ear in conjunction with a conventional earring, comprising:

an elongated curved rod formed to fit around an ear, the rod extending from its lower end, adapted to be located behind the ear lobe, upwardly and around to an upper end adapted to be positioned adjacent to the face of the top front corner of the ear;

a decorative member fixed to the upper end of the rod, the decorative member being adapted to extend downwardly along the face at a location forward of the ear; and vertically adjustable bracket means extending upwardly from the lower end of the rod for receiving the pin of an earring;

wherein the vertically adjustable bracket means comprises:

a telescoping extension at the lower end of the support;

a swiveled earring bracket mounted to the telescoping extension;

the swiveled earring brackets having an integral pair of bendable leaves, at least one of the leaves being apertured to receive the post of a conventional earring.

* * * * *